US009909827B1

(12) United States Patent
Higby

(10) Patent No.: US 9,909,827 B1
(45) Date of Patent: Mar. 6, 2018

(54) REVOLVER LOADER

(71) Applicant: Daniel L Higby, Scottsdale, AZ (US)

(72) Inventor: Daniel L Higby, Scottsdale, AZ (US)

( * ) Notice: Subject to any disclaimer, the term of this patent is extended or adjusted under 35 U.S.C. 154(b) by 0 days.

(21) Appl. No.: 15/330,583

(22) Filed: Oct. 14, 2016

Related U.S. Application Data

(60) Provisional application No. 62/284,971, filed on Oct. 15, 2015.

(51) Int. Cl.
*F41A 9/85* (2006.01)

(52) U.S. Cl.
CPC ..... *F41A 9/85* (2013.01)

(58) Field of Classification Search
CPC ..... F41A 9/85; F41A 9/84; F41A 9/82; F41A 9/83
USPC ..... 42/89, 59, 61, 62, 88
See application file for complete search history.

(56) References Cited

U.S. PATENT DOCUMENTS 1,228,505 A * 6/1917 Wesson ..... F41A 9/85 42/89
1,964,171 A * 6/1934 Pflaume ..... F41A 9/85 42/89
2,406,232 A * 8/1946 Lima ..... F41A 9/85 184/82
2,637,930 A * 5/1953 Mason ..... F41A 9/85 42/89
3,182,417 A * 5/1965 Hamilton ..... F41A 9/85 42/89
3,197,907 A * 8/1965 Olson ..... F41A 9/85 42/89
3,503,150 A * 3/1970 Bye ..... F41A 9/85 42/89
3,541,716 A * 11/1970 Fordham ..... F41A 9/85 42/89
4,202,124 A * 5/1980 Switzer ..... F41A 9/85 42/89
4,313,275 A * 2/1982 Switzer ..... F41A 9/85 42/89
4,796,371 A * 1/1989 Daniels ..... F41A 9/85 42/89

(Continued)

FOREIGN PATENT DOCUMENTS

DE 19512632 A1 * 10/1996 ..... F41A 9/85

*Primary Examiner* — John Cooper
(74) *Attorney, Agent, or Firm* — Tod R. Nissle, P.C.

(57) ABSTRACT

A revolver cartridge loader includes a plunger and a base. The plunger includes an array of circumferentially equally spaced cartridge engaging feet each including a distal end, includes a first aperture having a first diameter, and includes a second aperture operatively associated with the first aperture. The second aperture has an upper end and a lower end, and has a second diameter less than the first diameter. The base includes a plurality of circumferentially equally spaced openings each shaped and dimensioned to slidably receive a different one of the cartridge engaging feet. The base also includes an outwardly extending member integrally formed as a portion of the base. The outwardly extending member includes a resiliently compressible upper end shaped and dimensioned to compress resiliently to pass through the second aperture into the first aperture and, after passing through the second aperture, to expand into the first aperture to prevent the upper end from again passing through the second aperture.

1 Claim, 6 Drawing Sheets

(56) References Cited

U.S. PATENT DOCUMENTS 4,866,870 A * 9/1989 Johnson ..... F41A 9/85
42/89
5,842,299 A * 12/1998 Switzer ..... F41A 9/85
42/88

* cited by examiner

FIG. 10
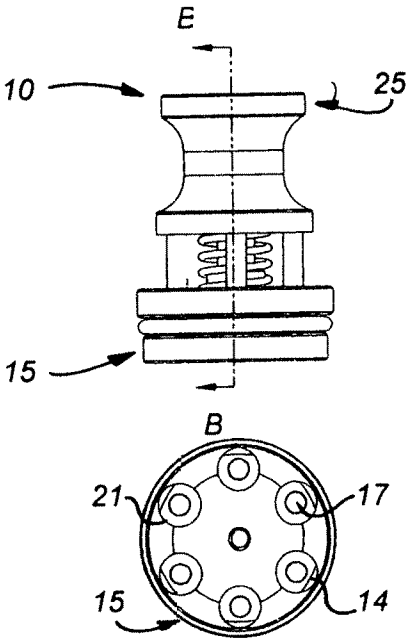
FIG. 11
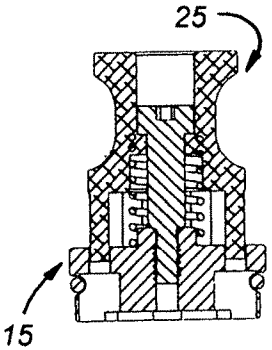
FIG. 12
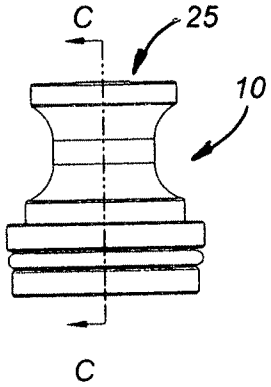
FIG. 13
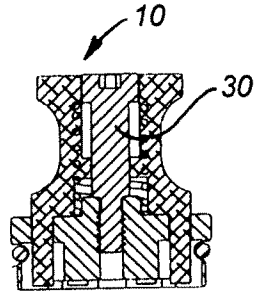
FIG. 14

FIG. 19
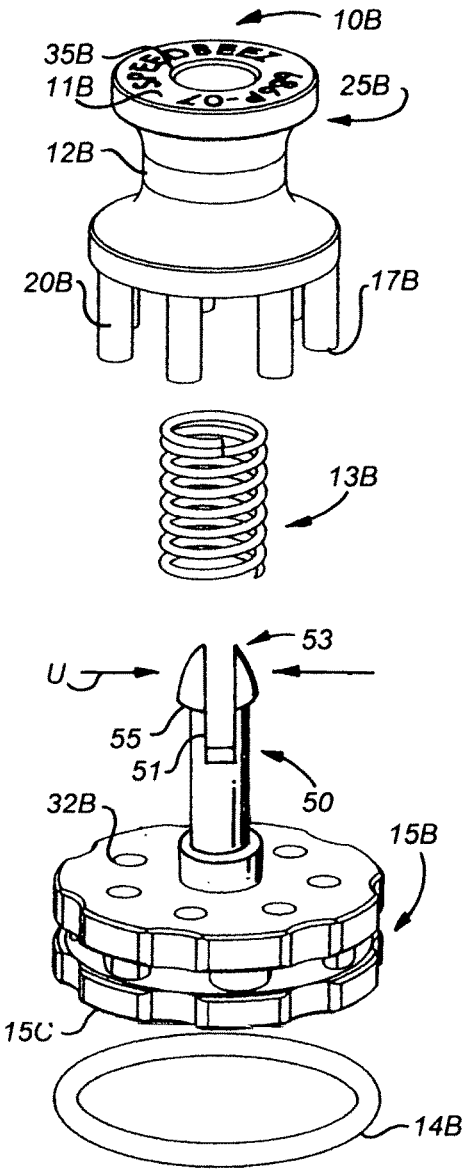
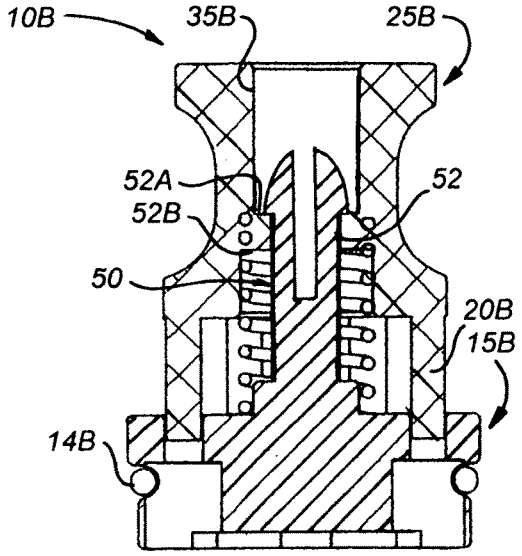
FIG. 20

REVOLVER LOADER

This application claims priority based on U.S. Provisional Patent Application Ser. No. 62/284,971 filed Oct. 15, 2015.

This invention relates to apparatus and methods for loading cartridges into a firearm.

More particularly, the invention relates to apparatus for loading cartridges into a revolver.

Those of skill in the art have long sought improved methods and apparatus to safely and quickly load cartridges into a revolver.

Therefore, it is highly desirable to develop new methods and apparatus to load cartridges into a revolver.

Accordingly, a principal objective of the invention is to provide improved methodologies and equipment to insert cartridges in a revolver.

This and other, further and more specific objects of the invention will be apparent to those skilled in the art from the following detailed description of the invention, taken in conjunction with the drawings, in which:

FIG. 10 is a side view illustrating the revolver loader of FIG. 3;

FIG. 11 is a side section view illustrating the revolver loader of FIG. 10 and taken along section line B-B;

FIG. 12 is a side view illustrating the revolver loader of FIG. 1;

FIG. 13 is a side section view illustrating the revolver loader of FIG. 12 and taken along section line C-C;

FIG. 14 is a bottom view illustrating the revolver loader of FIG. 10;

FIG. 19 is an exploded perspective view illustrating still another alternate embodiment of the invention; and, FIG. 20 is a section view illustrating the revolver loader of FIG. 19 assembled and in a pre-cartridge-ejection configuration.

Briefly, in accordance with the invention, provided is an improved revolver cartridge loader. The loader comprises a plunger including an array of circumferentially equally spaced cartridge engaging feet each including a distal end; a first aperture formed in the plunger and having a first diameter; a second aperture formed in the plunger, operatively associated with the first aperture, having an upper end and a lower end, and having a second diameter less than the first diameter; a first flange extending outwardly between the first aperture and the upper end of the second aperture; and, a second flange extending outwardly from said lower end of said second aperture. The loader also includes a base. The base comprises a plurality of circumferentially equally spaced openings each shaped and dimensioned to receive slidably a different one of the cartridge engaging feet; an upper spring engaging surface; an outwardly extending member integrally formed as a portion of the base and including a resiliently compressible upper end shaped and dimensioned to compress resiliently to pass through the second aperture into the first aperture and, after passing through the second aperture, to expand into the first aperture to prevent the upper end from again passing through the second aperture. The loader also comprises a resiliently compressible spring extending intermediate the upper spring engaging surface of the base and the second flange, and extending around the outwardly extending member.

Figure 1:
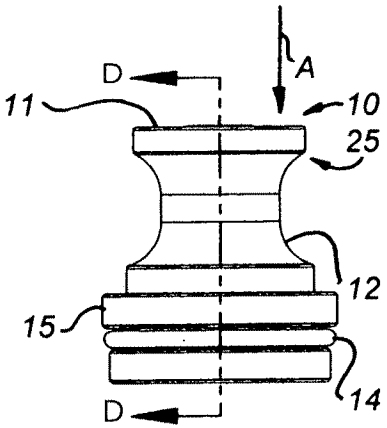
FIG. 1 is a side elevation view of a revolver loader constructed in accordance with the principles of the invention and illustrating the loader in its cartridge ejection configuration.
Figure 8:
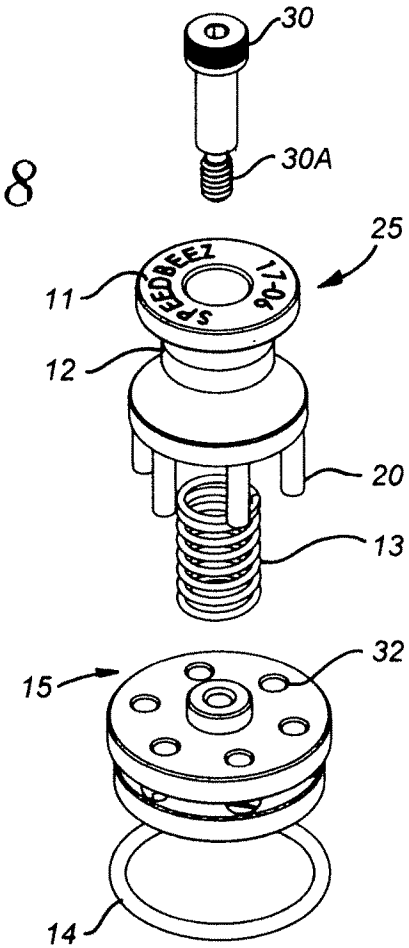
FIG. 8 is an exploded perspective view of the revolver loader of FIG. 7 illustrating additional construction details thereof.
Figure 17:
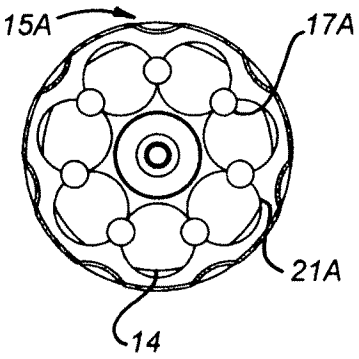
FIG. 17 is a bottom view illustrating the revolver loader of FIG. 15.
Figure 18:
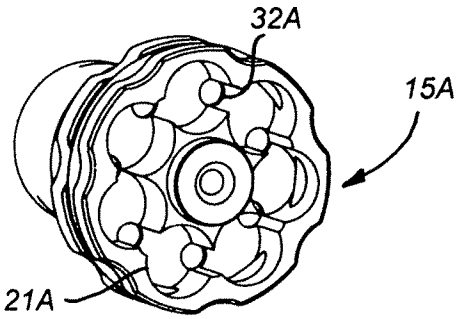
FIG. 18 is a perspective bottom view illustrating the revolver loader of FIG. 15.

Turning now to the drawings, which are provided by way of illustration and not limitation of the invention, and in which like characters refer to corresponding elements throughout the several views, FIGS. 1 to 14 illustrate a loader for a .22 caliber revolver. The loader is generally indicated by reference character 10. As shown in FIG. 1, the loader 10 includes a base 15 and a plunger 25 displaceably mounted on base 15. A fastener 30 (FIG. 2) with a threaded distal end 30A (FIG. 8) extends through an opening 35 (FIG. 6) formed in the center of plunger 25. The threaded distal end turns into an internally threaded opening 15D (FIG. 2) in base 15 such that fastener 30 remains in fixed position in base 15.

Figure 2:
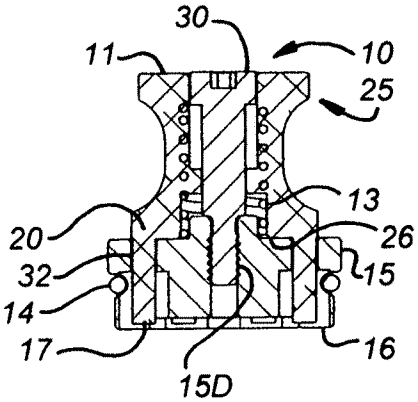
FIG. 2 is a section view of the revolver loader of FIG. 1 taken along section line D-D and illustrating further construction details thereof.
Figure 3:
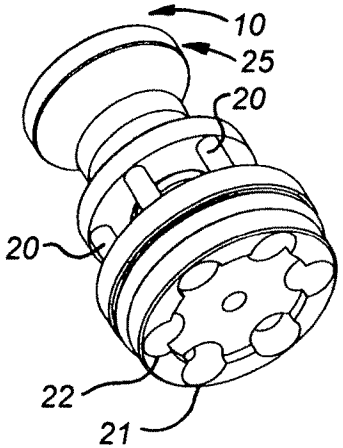
FIG. 3 is a perspective view of the revolver loader of FIG. 1 illustrating the loader in its normal pre-cartridge ejection operative configuration.
Figure 4:
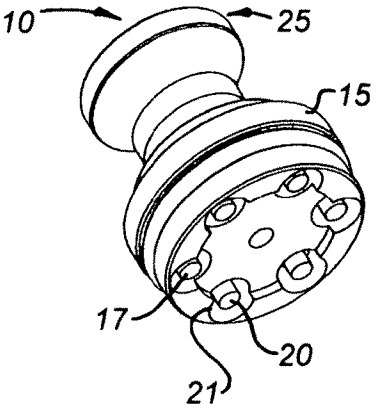
FIG. 4 is a perspective view of the revolver loader of FIG. 1 illustrating, in conjunction with the revolver loaders of FIGS. 1 and 2, the revolver loader of FIG. 1 in its cartridge ejection configuration.

Plunger 25 includes top surface 11 and circumferential arcuate concave detent 12. Plunger 25 also includes a plurality of downwardly extending cylindrically shaped legs 20 (FIG. 3). Each leg 20 includes a circular distal tip 17 (FIGS. 2 and 4) and extends slidably through an operatively associated cylindrical opening 32 (FIG. 2) formed and through upper surface 26 of base 15.

Spring 13 (FIGS. 2, 8, 9) is mounted internally and is operatively associated with plunger 25 and base 15. In particular, spring 13 is normally compressed (and is attempting to expand) and is in a first operative position illustrated in FIGS. 5 and 6 in which spring 13 functions to displace upwardly continuously plunger 25 to the retracted operative position, or configuration, of FIGS. 5, 6, 10 and 11. In the retracted operative configuration of FIGS. 5 and 6, each leg 20 (and the tip 17 of each leg) is displaced upwardly away from bottom 16 (FIG. 2) and the bottom face 36 (FIG. 9) of base 15 to a position which permits the end of each of six (6) cartridges to be inserted in a different one of openings 21 (FIG. 9) and the interior space 31 (FIG. 6) of base 15 such that retaining spring 14 engages a portion of the end of each cartridge. In particular, the end of each cartridge includes, in conventional fashion, an outwardly extending circumferential lip which extends between and is captured by spring 14 and an inset surface or face 36A (FIG. 9) formed in the bottom of base 15. After six (6) cartridges are placed in openings 21, 22 the tips (i.e., the bullet ends) of the cartridges are equally spaced with respect to each other and the cartridges are generally parallel to one another. The cartridges are then inserted in empty openings in the cylinder of a revolver by placing the tips of the cartridges adjacent the cylinder in registration with the equally spaced openings in the cylinder. The plunger 25 is then downwardly displaced in the direction of arrow A in FIG. 1 to move plunger 25 from the retracted operative position of FIGS. 5 and 6 to the deployed operative position illustrated in FIGS. 1, 2, 12, and 13. When plunger 25 moves from the retracted position to the deployed position, each leg 20 slides downwardly through its associate opening 32 in base 15 to the position shown in FIGS. 2 and 4, and, consequently, tips 17 each contact a cartridge, disengage from spring 14 the lip of the upper end of the cartridge, and displace, or push, the cartridges from base 15 into the openings in the revolver cylinder. As can be seen in FIG. 2, in the fully deployed position, tips 17 are slightly recessed from the bottom surface 36 (FIG. 9) of base 15, although this need not be the case. This recess facilitates separation of the upper end of each cartridge from its associated tip 17 when the cartridge is displaced into a revolver cylinder.

Loader 10 is configured such that each tip 17 contacts the center, and not the rim, of each .22 caliber cartridge.

Figure 6:
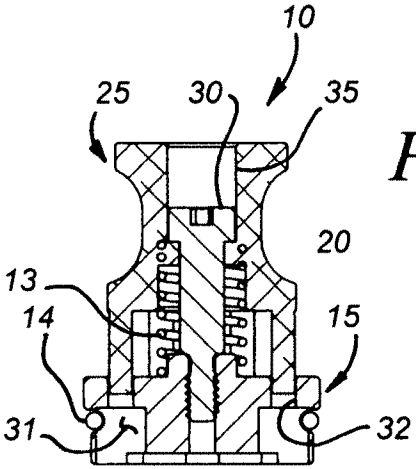
FIG. 6 is a side section view illustrating the revolver loader of FIG. 5 taken along section line A-A and illustrating further construction details thereof.
Figure 5:
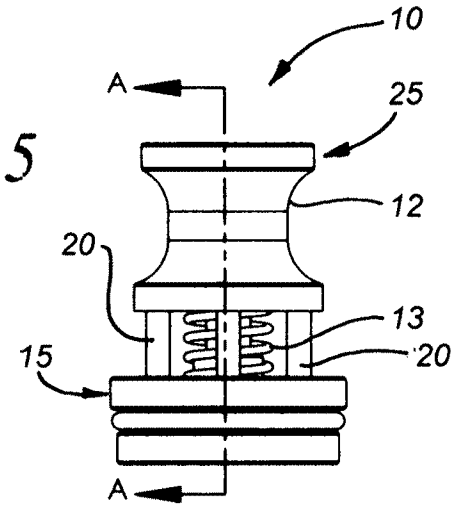
FIG. 5 is a side elevation view illustrating the revolver loader of FIG. 3.
Figure 7:
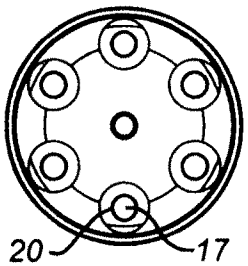
FIG. 7 is a bottom view illustrating the revolver loader of FIG. 5.
Figure 9:
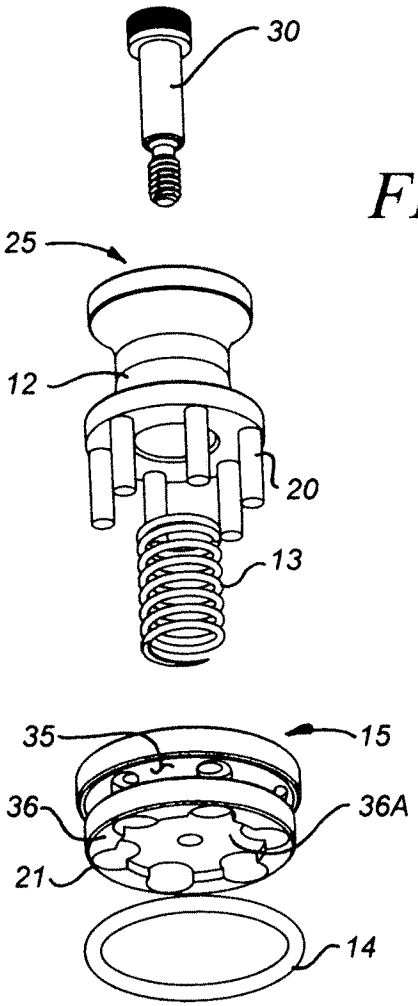
FIG. 9 is an exploded perspective view of the revolver loader of FIG. 7 illustrating additional construction details thereof.

One advantage of loader 10 is that when plunger 25 is in the retracted position of FIG. 6, fastener 30 is inset inside plunger 25 and a user can therefore readily displace plunger 25 by pushing on top surface 11, as well as by grasping plunger 25 about detent 12 and displacing plunger 25 in the direction of arrow A.

The depth of each opening 21 determines how far the end of a cartridge extends into base 15. This depth is reduced as much as possible to minimize the distance that the end of a cartridge has to be moved from opening 21 when plunger 25 is moved from the retracted operative position to the deployed operative position. There is, however, a practical limit to how much the depth of openings 21 can be reduced since an important function of the openings 21 is to hold each cartridge and to guide each cartridge along a generally linear path of travel when plunger 25 is moved from a retracted operative position to a deployed operative position. The Depth of each opening is currently preferable in the range of 3⁄16 inch to ¾, but can vary as desired.

FIGS. 15 to 18 illustrate a revolver loader which is generally indicated by reference character 10A. Loader 10A is comparable in structure and function to loader 10, except that loader 10A is configured to load .38 caliber cartridges and, therefore, is configured such that the tips 17A (FIG. 17) of each leg 20A each contact portions of the rims of .38 caliber cartridges and do not contact the center of a cartridge.

Loader 10A, in a fashion similar to loader 10, includes a plunger 25A with a top surface 11A, includes a circumferential concave detent 12A, includes fastener 30A which is recessed in a plunger 25A when plunger 25A is in the retracted position, and includes legs 20A each with a distal tip 17A. Base 15A includes openings 32A each of which slidably receives a leg 20A, and includes openings 21A each shaped and dimensioned to receive the upper end of a .38 cartridge when plunger 25A is in the retracted position. As used herein, the upper end of a cartridge comprises the end with the outwardly extending lip or flange, and the lower end of cartridge comprises the tip of the cartridge and of the bullet retained in the cartridge. Compressed spring 13A functions in a manner comparable to spring 13 and maintains plunger 25A in a retracted operative position until a user downwardly displaces plunger 25A toward base 15A to eject into a revolver cylinder cartridges which have been inserted in and are held in base 15A by retaining spring 14A. When plunger 25A is downwardly displaced, spring 13A is compressed further. After plunger 25A is downwardly displaced and then released, spring 13A expands to return plunger 25A to its retracted position.

An alternate embodiment of a revolver loader of the invention is illustrated in FIGS. 19 and 20 and is generally indicated by reference character 10B. Loader 10B is comparable in structure and function to loaders 10 and 10A. Loader 10B is configured to load .38 caliber cartridges and, therefore, is configured such that the tips 17A of each leg 20A each contact portions of the outer rims of .38 caliber cartridges and do not contact the center of the cartridge.

Figure 16:
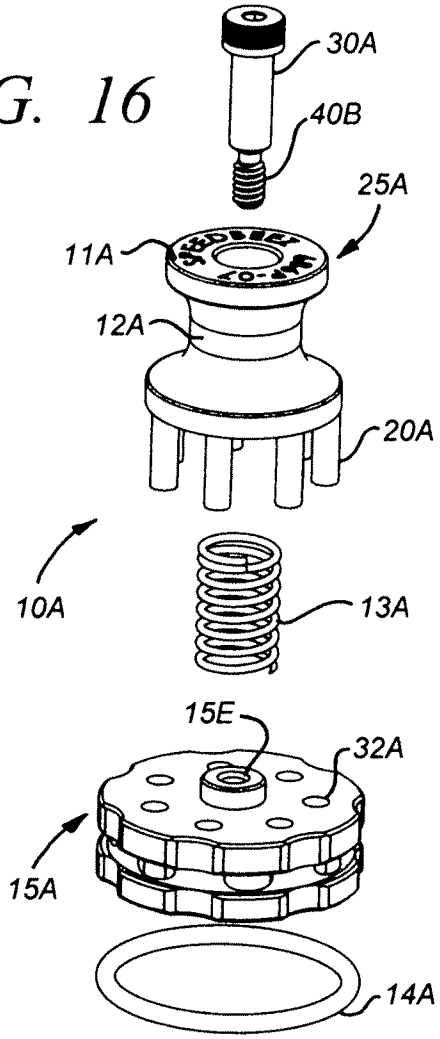
FIG. 16 is an exploded perspective view of the revolver loader of FIG. 15 illustrating additional construction details thereof.
Figure 15:
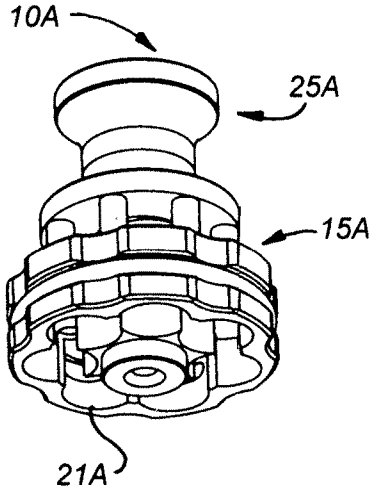
FIG. 15 is a perspective view of an alternate embodiment of the invention in a pre-cartridge-ejection configuration.

Loader 10B, in a fashion similar to loader 10A, includes a plunger 25B with a top surface 11B, a circumferential detent 12B, and legs 20A each with a distal tip 17B. Base 15B includes openings 32B each of which slidably receives a leg 20B, and includes openings comparable to openings 21A and each shaped and dimensioned to receive the upper end of a .38 cartridge when plunger 25B is in a retracted position. Spring 13B functions in a manner comparable to spring 13A and maintains plunger 25B in a retracted operative position until a user downwardly displaces plunger 25B toward base 15B to eject into a revolver cylinder cartridges which have been inserted in and are held in base 15B by spring 14B. Fastener 30A illustrated in FIG. 16 is eliminated, along with the internally threaded opening 15E (FIG. 16) which is formed in base 15A to received rotatably the externally threaded end 40B of fastener 30A. Instead, upstanding member 50 is integrally formed with base 15B as a part of base 15B. The resiliently compressible upper end 53 of member 50 is tapered and slot 51 is formed in the upper end of member 50 such that during the assembly of loader 10B, spring 13B slides over member 50 to the position illustrated in FIG. 20 when plunger 25 is pressed downwardly onto base 15B. When plunger 25 is pressed downwardly onto base 15B, aperture 52 is forced downwardly over end 53, resiliently compressing end 53 in the manner indicated by arrows U. Compressing end 53 forces portions of end 53 toward one another to reduce the width of slot 51. After compressed end 53 passes completely through aperture 52 and into opening 35B, the portions of end 53 resiliently rebound outwardly to the normal operative position illustrated in FIG. 19. After portions of end 53 resiliently rebound outwardly to the normal operative position illustrated in FIG. 19, bottom surfaces 55 contact portions of a first upper circular flange surface 52A, preventing end 53 from passing downwardly through aperture 52. Flange surface 52A extends outwardly from the top of aperture 52. Second circular flange surface 52B extends outwardly from the bottom of aperture 52. Compressed spring 13B functions to displace continuously plunger 25B upwardly to press surface 52A against bottom surfaces 55 (FIGS. 19 and 20) of end 53. Importantly, eliminating fastener 30A significantly reduces manufacturing and assembly costs and makes the loader 10B safer by making it extremely difficult for a child to disassemble plunger 25B from base 15B.

When plunger 25B is fully depressed to a position comparable to that shown in FIG. 2 in order to eject .38 cartridges from base 156, tips 17B are recessed in base 15B a selected distance from lower edge 15C of base 15B. This spacing insures that tips 17B will not contact and apply pressure to cartridges after cartridges have been loaded into a revolver. This safety feature (along with the fact that tips 17B contact the rims, and not the centers, of .38 cartridges) greatly reduces and, practically speaking, eliminates the likelihood that pressure applied to the rims of cartridges once they are loaded in a revolver can accidently fire one of the cartridges.

Having described my invention in such terms as to enable those skilled in the art to understand and practice the invention, and having, without limitation to the scope of the invention, described presently preferred embodiments thereof.

I claim:

1. A revolver cartridge loader including (a) a plunger including (i) an array of circumferentially equally spaced cartridge engaging feet each including a distal end, (ii) a first aperture formed in said plunger and having a first diameter, (iii) a second aperture formed in said plunger, operatively associated with said first aperture, having an upper end and a lower end, and having a second diameter less than said first diameter, (iv) a first flange surface (52A) extending outwardly between said first aperture and said upper end of said second aperture, (v) a second flange extending outwardly from said lower end of said second aperture, (b) a base including (i) a plurality of circumferentially equally spaced openings each shaped and dimensioned to slidably receive a different one of said cartridge engaging feet, (ii) an upper spring engaging surface, (iii) an outwardly extending member (50) integrally formed as a portion of said base and including a resiliently compressible upper end shaped and dimensioned to compress resiliently to pass through said second aperture into said first aperture and, after passing through said second aperture, to expand into said first aperture to prevent said upper end from again passing through said second aperture; and (c) a resiliently compressible spring extending (i) intermediate said upper spring engaging surface of said base and said second flange surface, and (ii) around said outwardly extending member.

* * * * *